US009298166B2

(12) United States Patent
Lagorgette et al.

(10) Patent No.: US 9,298,166 B2
(45) Date of Patent: Mar. 29, 2016

(54) OPTIMIZED MULTIFUNCTION DISPLAY DEVICE

(71) Applicant: ETA SA Manufacture Horlogere Suisse, Grenchen (CH)

(72) Inventors: Pascal Lagorgette, Bienne (CH); Raphael Balmer, Courrendlin (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 0 days.

(21) Appl. No.: 14/573,478

(22) Filed: Dec. 17, 2014

(65) Prior Publication Data

US 2015/0168918 A1 Jun. 18, 2015

(30) Foreign Application Priority Data

Dec. 18, 2013 (EP) ..... 13198182

(51) Int. Cl.
*G04C 17/00* (2006.01)

(52) U.S. Cl.
CPC ..... *G04C 17/0058* (2013.01); *G04C 17/0066* (2013.01)

(58) Field of Classification Search
CPC .... G04B 19/247; G04B 19/26; G04B 19/262; G04B 19/266; G04B 19/268
USPC ..... 368/37, 232, 234, 247
See application file for complete search history.

(56) References Cited

U.S. PATENT DOCUMENTS

| | | | | |
|---|---|---|---|---|
| 2,583,797 | A * | 1/1952 | Rosfelder | 368/234 |
| 3,621,648 | A * | 11/1971 | Takagi | 368/37 |
| 4,422,775 | A | 12/1983 | Thoenig | |
| 5,724,318 | A * | 3/1998 | Mossuz | 368/37 |
| 8,787,123 | B2 * | 7/2014 | Takenawa | 368/233 |
| 8,971,153 | B2 * | 3/2015 | Takenawa | 368/37 |
| 2006/0221772 | A1 * | 10/2006 | Vuilleumier et al. | 368/28 |
| 2008/0170474 | A1 | 7/2008 | Behling et al. | |
| 2009/0154296 | A1 | 6/2009 | Behling et al. | |
| 2013/0033970 | A1 * | 2/2013 | Miyake | 368/80 |
| 2013/0051198 | A1 * | 2/2013 | Sato et al. | 368/235 |
| 2013/0077450 | A1 * | 3/2013 | Fleury et al. | 368/80 |

FOREIGN PATENT DOCUMENTS

| | | | |
|---|---|---|---|
| EP | 0 075 535 | A1 | 3/1983 |
| WO | WO 2007/031347 | A1 | 3/2007 |

OTHER PUBLICATIONS

European Search Report issued Jul. 8, 2014, in European Application No. 13198182.1 filed Dec. 18, 2013 (with English Translation).

* cited by examiner

*Primary Examiner* — Sean Kayes
(74) *Attorney, Agent, or Firm* — Oblon, McClelland, Maier & Neustadt, L.L.P

(57) ABSTRACT

The invention concerns a multifunction display device for a watch including a rotating assembly having time indicators and function indicators, said rotating assembly being moved in rotation by a directional means, said display device being characterized in that the function indicators appear at least two times so that the rotating assembly presents the time indicators once and the function indicators at least twice.

10 Claims, 6 Drawing Sheets

OPTIMIZED MULTIFUNCTION DISPLAY DEVICE

This application claims priority from European patent application No. 13198182.1 filed Dec. 18, 2013, the entire disclosure of which is hereby incorporated herein by reference.

The invention relates to a multifunction display device on a watch.

PRIOR ART

With the aid of hands on a fixed dial bearing time markings, a watch displays the hour, the minutes and the seconds. It may also display the days of the month in addition to the months and/or the days of the week by means of a disc which also bears time indicators appearing through an aperture.

In order to set the date, a setting button is actuated, typically a crown, which actuates rotation of the disc, and the markings are scrolled past until the required one is reached. As a general rule, rotation is only possible in one direction. The means are therefore one-directional, although two-directional systems, which are of course more complicated, exist.

Along the same lines, the disc may bear the time markings and also markings corresponding to functions such as the chronograph CHRONO or alarm ALARM ON, ALARM OFF, etc.

These function indicators are inserted behind the dates. The disc thus bears thirty-one time indicators and the number of functional indicators comprised in the watch. The size of these indicators is often defined such that all the indicators together cover 360° in order to be readable. For reasons of readability, the number of positions for the dates and for the functions is approximately 40 to ensure that the characters are sufficiently large.

When it is desired to select a function, a command is actuated which sets the disc in rotation and presents the function behind the aperture so that said function can then be validated.

As for the dates, the control means are often one-directional and consequently if the function is missed during the rotation, the disc has to be rotated through virtually an entire revolution. This operation takes between 30 and 60 seconds to complete a 360° rotation.

Although, generally, selection of the date does not occur often, selection of a function is more frequent and this wait of 30 to 60 seconds if the position is missed or if it is desired to scan the available functions before making a selection, is tedious.

SUMMARY OF THE INVENTION

It is one of the objects of the present invention to provide a multifunction display device which overcomes the aforementioned drawbacks, that is to say by providing a multifunction display device which is fast to use in the event of an error in handling.

To this end, the invention relates to a multifunction display device for a watch including a rotating assembly presenting time indicators and function indicators, said rotating assembly being moved in rotation by a unidirectional means, this display device being characterized in that the function indicators appear at least twice so that the rotating support presents the time indicators once and the function indicators at least twice.

In a first advantageous embodiment, the rotating assembly includes a rotating support, with time indicators and function indicators being disposed on the periphery thereof.

In a second advantageous embodiment, the rotating assembly includes a first rotating support including time indicators, said first rotating support, which has a hole able to coincide with the aperture in the dial, and a second support on which the function indicators are listed several times; control means of the watch are formed to set in rotation the support bearing the time indicators, in a first function search mode of operation, to position the hole before the aperture so as to make the second rotating support visible underneath the hole.

In a third advantageous embodiment, the rotating assembly includes a first rotating support on which the function indicators are listed several times, said first rotating support, which has a hole able to coincide with the aperture in the dial, and a second support including the time indicators, the hole in the first rotating support coinciding with the aperture in the dial in a normal operating mode in which the current time is displayed; the rotating assembly further including control means of the watch formed to set in rotation the first rotating support, in a function search mode of operation, to position the function indicators facing the aperture in the dial.

In a fourth advantageous embodiment, the function indicators are divided into at least two groups each disposed one behind the other.

In a fifth advantageous embodiment, the time indicators are divided into two groups and a group of function indicators is inserted between each group of time indicators.

In another advantageous embodiment, at least one function indicator is inserted between two time indicators.

In another advantageous embodiment, the time indicators are date indicators.

The present invention also concerns a watch including a timepiece movement and control means for acting on said timepiece movement, said timepiece movement including the multifunction display device according to any of the preceding claims.

In an advantageous embodiment, said timepiece movement is electronic.

BRIEF DESCRIPTION OF THE DRAWINGS

The objects, advantages and features of the multifunction display device according to the present invention will appear more clearly in the following detailed description of at least one embodiment of the invention, given solely by way of non-limiting example and illustrated by the annexed drawings, in which.

DETAILED DESCRIPTION OF THE INVENTION

Figure 1:
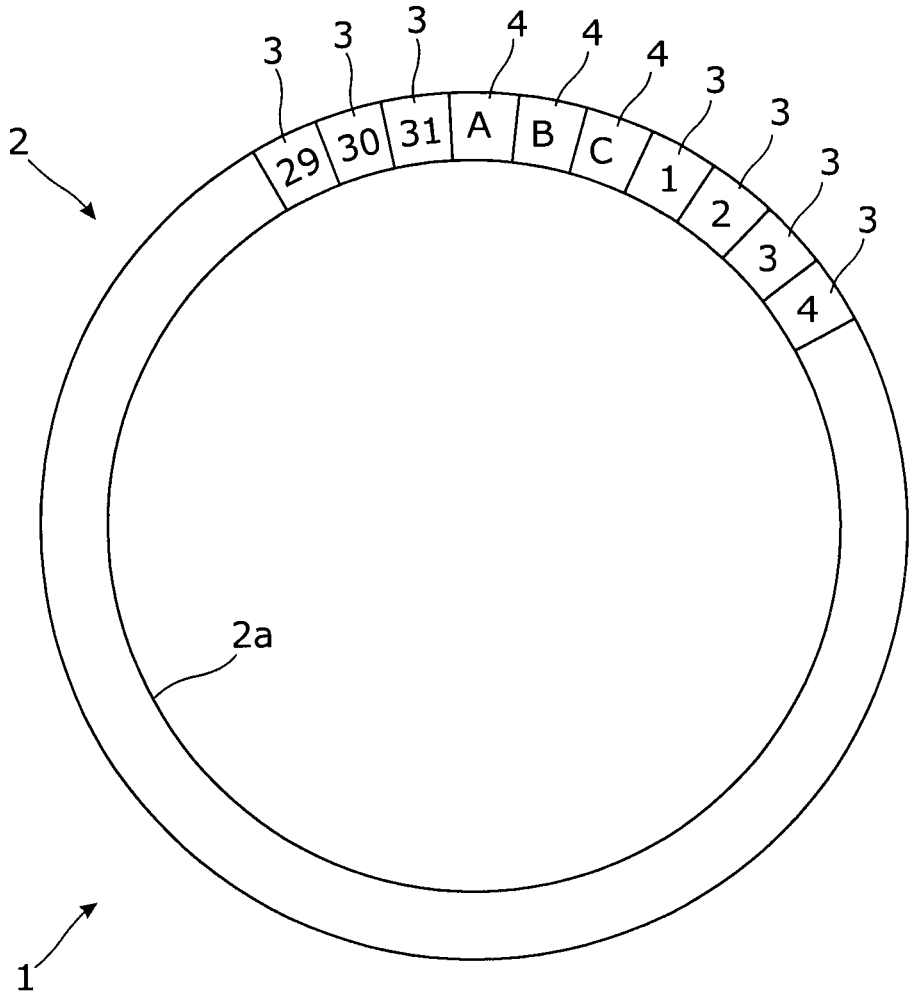
FIG. 1 shows a display device according to the state of the art.

Referring to the drawings of FIGS. 1 to 7, there is shown a device 1 for displaying the days of the month, i.e. the figures from one to thirty-one. This device is used in a timepiece movement behind a dial 5 (shown in FIG. 6). These dates are time indicators 3. They are marked on the periphery of a rotating assembly 2 and are positioned chronologically behind an aperture 6 in a dial (seen in FIG. 6). This rotating assembly 2 is driven by a unidirectional motor element which has the advantage of being simple to produce.

This timepiece movement is preferably an electronic movement including a control circuit (not shown), in which rotating assembly 2 is driven by an independent stepping or piezoelectric motor. The utilisation of such a motor is advantageous since it can have a high rotational velocity.

In addition to these time indicators, the rotating support has function indicators 4 such as, for example, CHRONO, ALARM ON, ALARM OFF, etc.

The watch operates as follows. When the date display is active, if the CHRONO function is required, a setting command is first of all actuated, which rotates rotating assembly 2 and brings the function, for example CHRONO, before the aperture, a command is then actuated and the function CHRONO is validated.

FIG. 1 shows the state of the art which consists in making the thirty-one time indicators appear, one after the other, then the function indicators A, B, C. When the motor means moving the rotating support is one-directional, if the support is inadvertently rotated beyond the CHRONO position, it must be rotated again.

To avoid this waste of time, the function indicators 4 appear at least twice so that the rotating assembly presents the thirty-one date indicators 3 and at least two times the X function indicators, X being the number of available functions. In a non-limiting example, the number of positions for the dates and for the functions is forty to ensure that the characters are sufficiently large. Thus, since there are thirty-one positions for the dates, it is possible to have three functions indicated twice. If only two functions are envisaged, they may be indicated three or even four or more times. However, the maximum or minimum number of positions is not fixed; this depends on the size of the discs.

In a first embodiment, rotating assembly 2 includes a rotating support 2*a* taking the form of a disc. This disc may be solid or annular.

Figure 2:
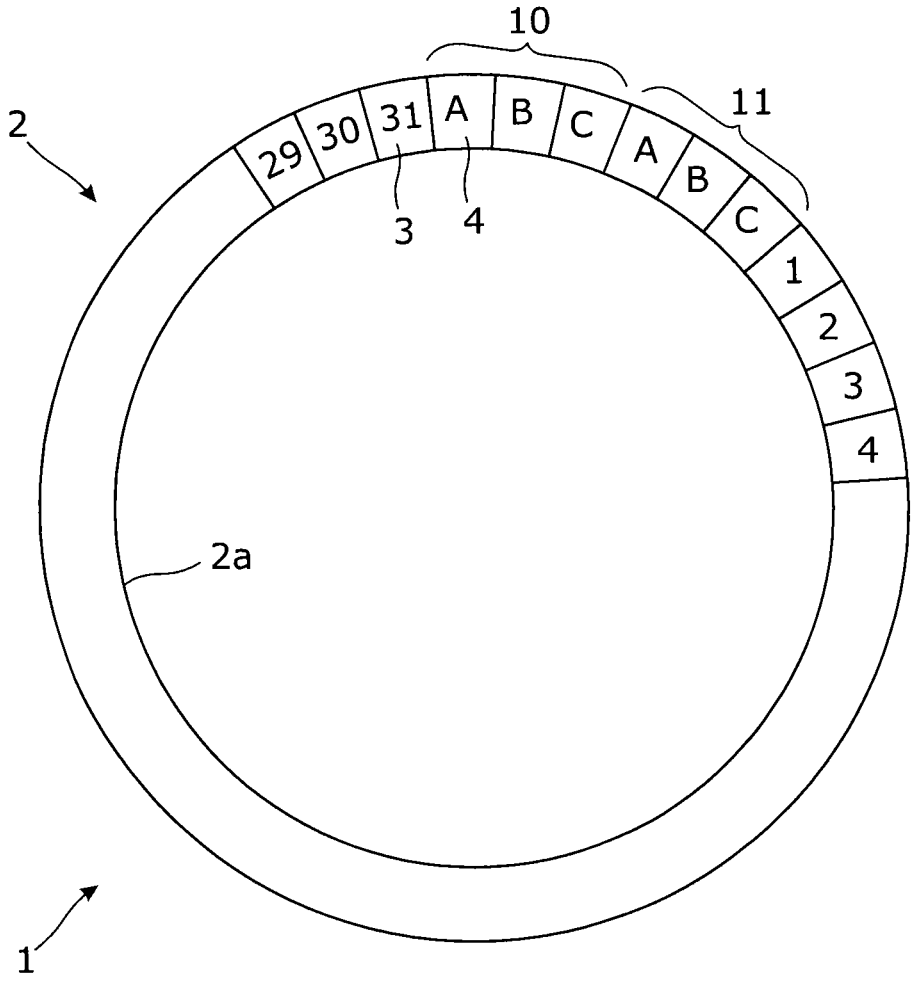
FIG. 2 shows a first embodiment of the display device of the invention.

In one form of this first embodiment seen in FIG. 2, function indicators 4 are divided into two groups 10, 11 arranged one behind the other. Therefore, there are, in succession, the dates (1 to 31) the first group 10 of functions (A, B, C), and then the second group 11 of functions (A, B, C). Thus, if function B of the first group 10 is missed, it is possible to retrieve function B of the second group 11.

This configuration advantageously makes it possible to retrieve a missed function or to read through all the available functions before making a selection.

Figure 3:
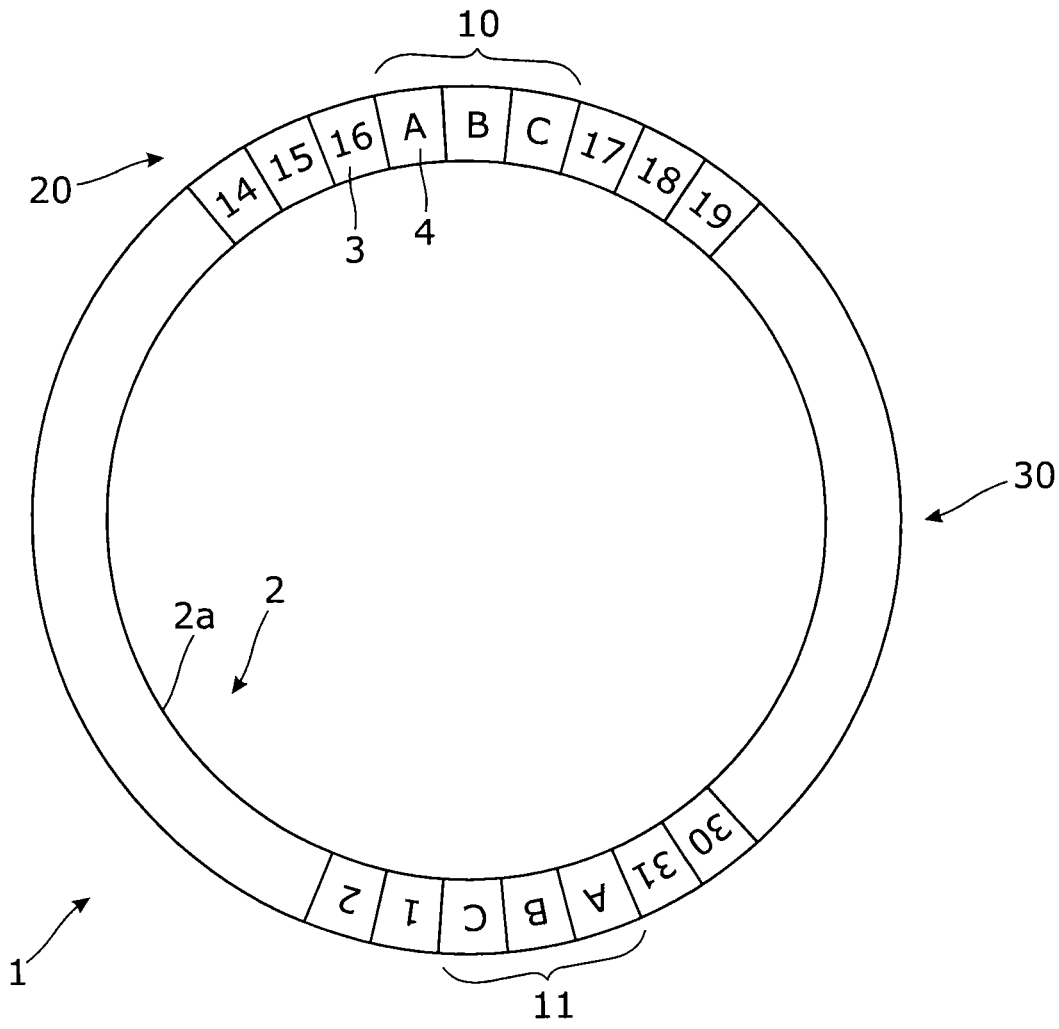
FIG. 3 shows a first variant of the display device of the invention.

According to a first variant seen in FIG. 3, time indicators 3 are divided into two groups 20, 30 and a group 10, 11 of function indicators 4 is inserted between each group of time indicators 3. For example, a first group 20 of time indicators 1 to 16 can be read on rotating support 2*a*, then a group 10 of function indicators A, B, C, then a group 30 of time indicators 17 to 31, and again a group 11 of function indicators A, B, C.

This first variant embodiment decreases the time between the two groups of function indicators 10, 11 since only a half-turn of the disc is required to change from one function group to the other. Further, with the utilisation of an electric motor for rotating the disc acting as rotating support 2*a*, it is possible to achieve a faster rotation for changing from group 10 of function indicators A, B, C to group 11 of function indicators A, B, C and thereby decrease the waiting time.

Figure 4:
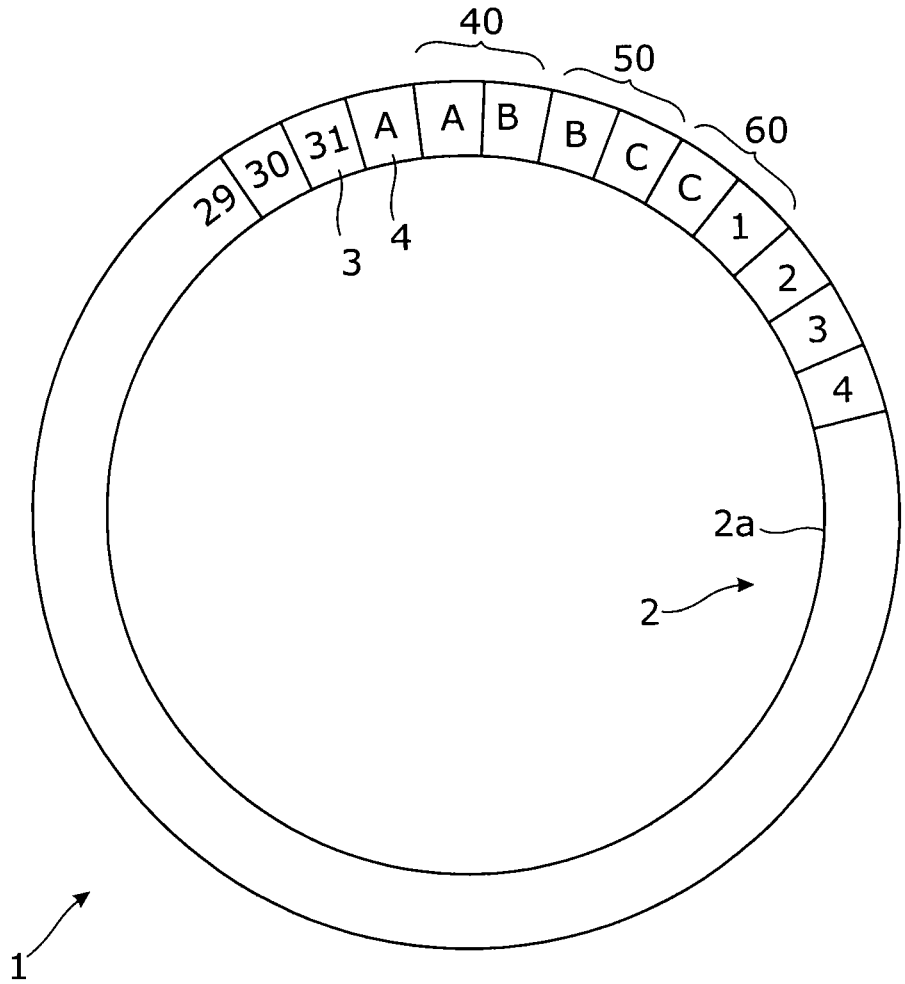
FIG. 4 shows a second variant of the display device of the invention.
Figure 5:
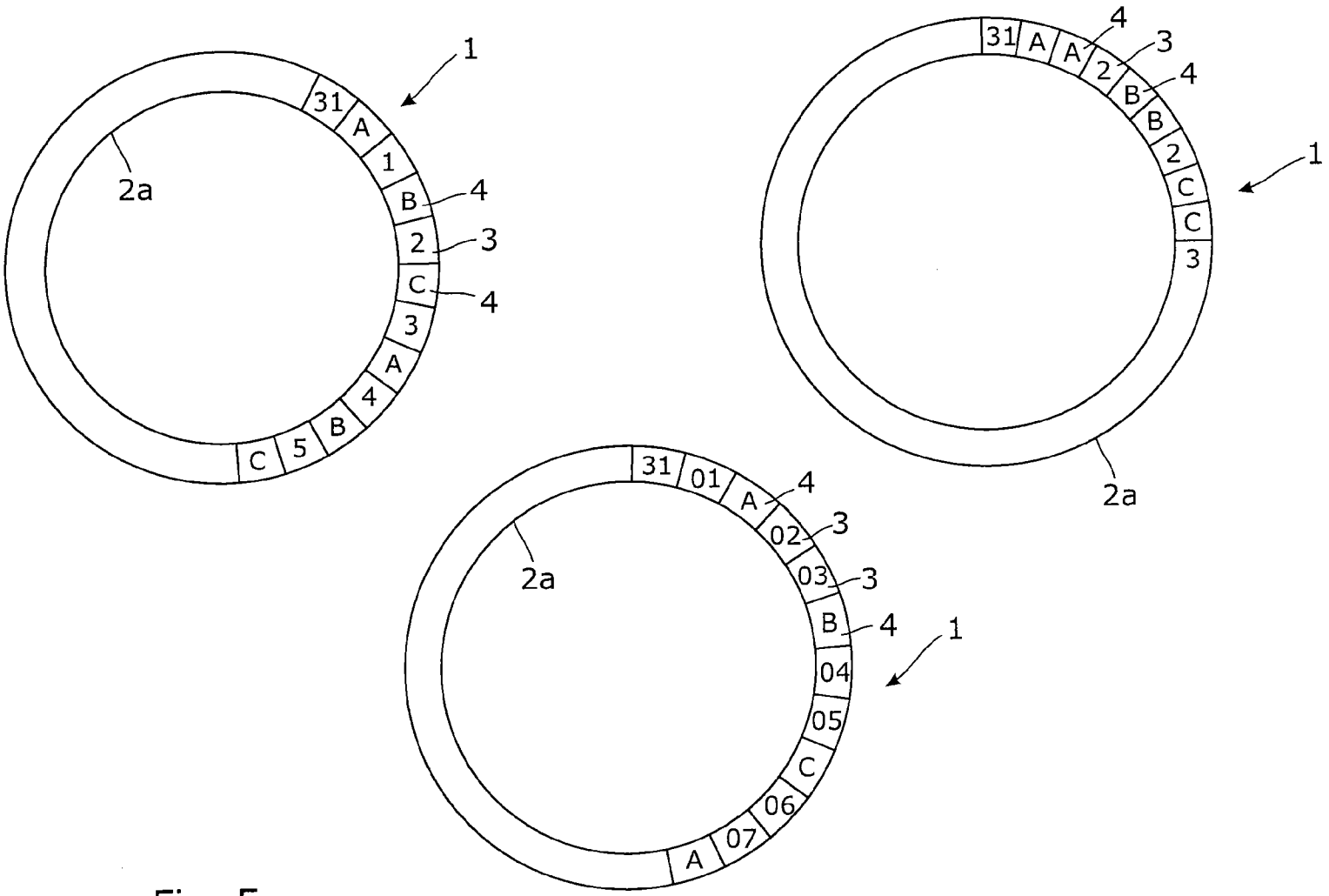
FIG. 5 shows a third variant of the display device of the invention.

According to a second variant embodiment of FIG. 4, the function indicators 4 are grouped by function (two by two, in the example) and are positioned following the time indicators 3. Here, a group 40 is formed with two times function A, a group 50 with two times function B and a group 60 with two times function C. Thus, when the first function A is reached too quickly, the second function A can be found in the next position. The user does not need to scan through all of the functions to be able to select a previously missed function.

According to a third variant embodiment, at least one function indicator 4 is inserted between two time indicators 3. It is possible to have a time indicator 3 inserted between two function indicators 4 or two time indicators 3 inserted between two function indicators 4.

For example, the following date sequence is formed: date 10, followed by function A, followed by date 11, followed by function A, followed by date 12, followed by function B, followed by date 13, followed by function B.

This configuration is possible depending on the motor characteristics Indeed, to change from one function indicator 4 to another, in theory it is necessary to pass through a time indicator 3. With a motor driving rotating support 2*a* that is capable of rotating at a high velocity, it is possible to envisage programming the electronic movement so that the change from one function indicator 4 to another occurs at a velocity such that the time indicator 3 inserted between these two function indicators 4 is invisible to the user. It is thus understood that the rotational step taken by the disc to place time indicator 3 before the aperture is taken at a high velocity so that the user does not see it.

It is also possible to place the same function once or twice between two dates.

Figure 6:
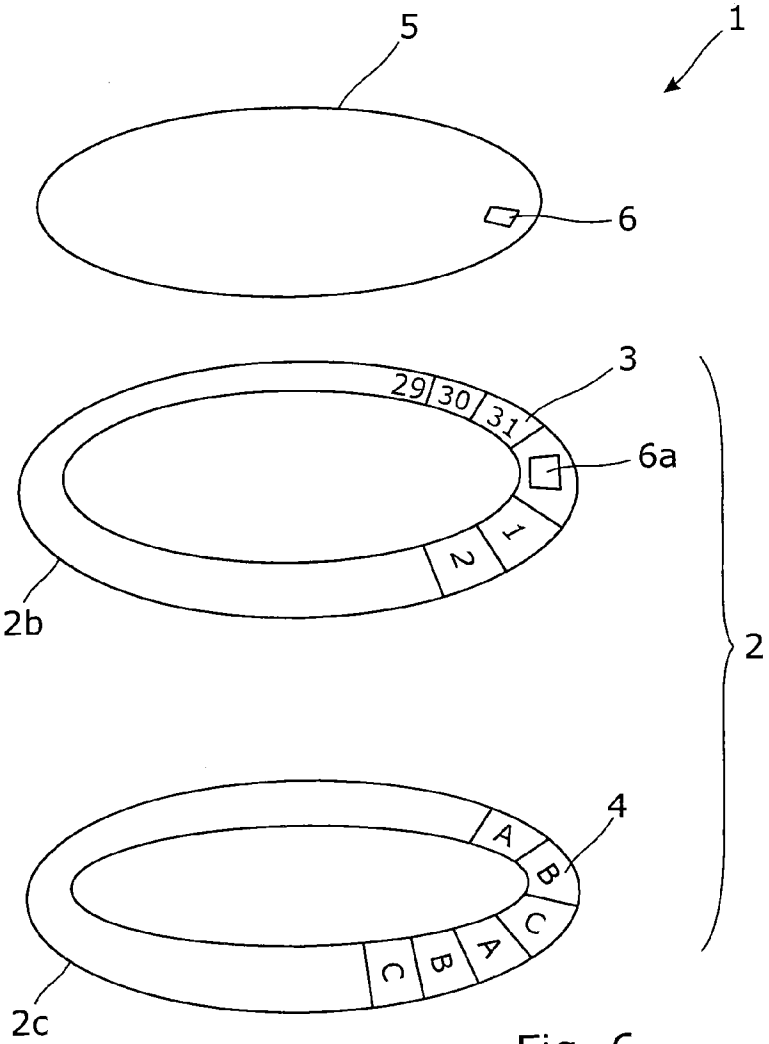
FIG. 6 shows a second embodiment of the display device of the invention.

In a second embodiment which appears in FIG. 6, rotating assembly 2 includes several rotating supports 2*a* taking the form of a disc. This disc may be solid or annular. Each rotating support 2*a* is driven unidirectionally by a motor.

The dates or time indicators 3 are marked on a first rotating support 2*b* which has a hole or opening 6*a* able to coincide with aperture 6 in dial 5 and the function indicators 4 are listed several times on a second rotating support 2*c*. First rotating support 2*b* and second rotating support 2*c* are superposed and coaxially arranged. They can start to rotate independently.

Control means are formed so that, when changing to a function search, support 2*b* of time indicators 3 is set in rotation so as to place hole 6*a* before aperture 6. Once hole 6*a* is before aperture 6, second rotating support 2*c* becomes visible to the user. The user can then act on the control means to turn the second rotating support 2*c* underneath hole 6*a* and to select the required function.

Figure 7:
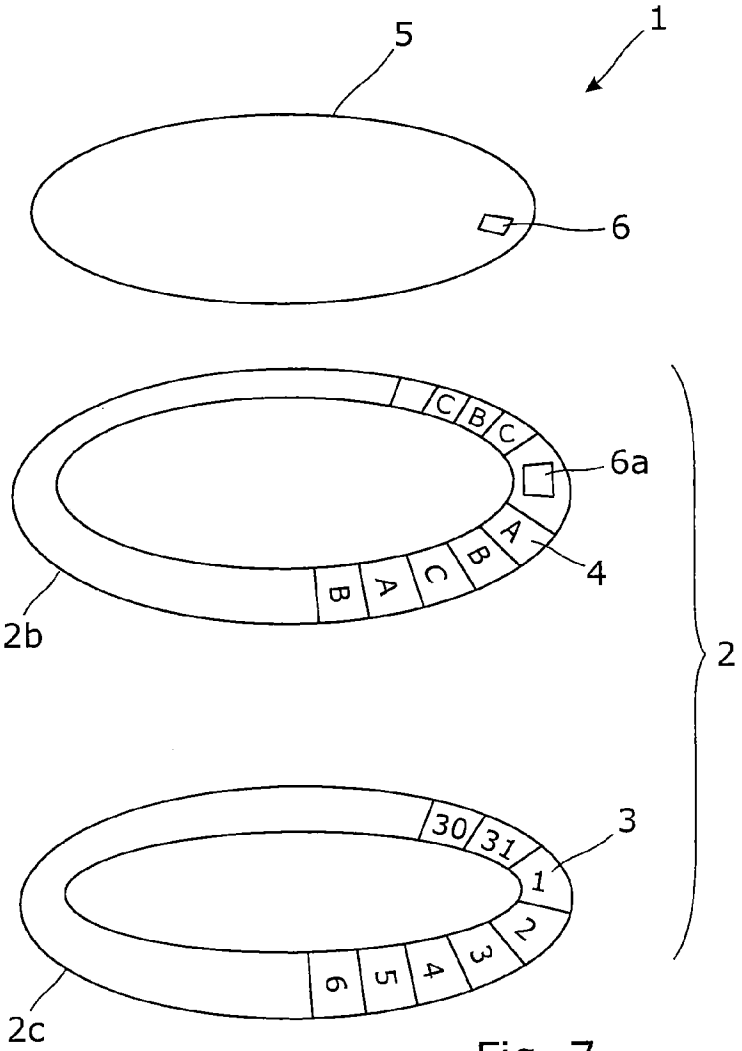
FIG. 7 shows a variant of the second embodiment of the display device of the invention.

In a variant of this second embodiment seen in FIG. 7, the discs are reversed. Function indicators 4 are marked several times on first rotating support 2*b* which has a hole or opening 6*a* able to coincide with aperture 6 in dial 5 and time indicators 3 are listed on a second rotating support 2*c*.

Normally, the hole in first rotating support 2*b* is opposite the aperture in the dial so that the time indications are visible on the second support.

When a function is to be selected and after the appropriate control means have been actuated, the first rotating support 2*b* starts to rotate to place a function indicator before the aperture in the dial. This first rotating support 2*b* will be arranged so that the first step in its rotation makes the first function visible.

When the function is selected or the timepiece movement including the display device changes back into a normal mode in which the current time is displayed, the first rotating support 2*b* is moved so that hole 6*a* therein is positioned opposite aperture 6 in dial 5.

The distribution of functions over the rotating support may be of the type A, B, C, A, B, C with the groups of functions following each other, or A, A, B, B, C, C, with the function indicators being grouped by function. Further as the second rotating support is exclusively dedicated to the functions, it is possible to have a larger number of functions, or indicators that are easier to read.

It will be clear that various alterations and/or improvements and/or combinations evident to those skilled in the art may be made to the various embodiments of the invention set out above without departing from the scope of the invention defined by the annexed claims.

However, a mechanical movement could be used wherein rotating assembly 2 is driven by an assembly comprising an energy source, gear trains and a balance-escapement system also providing the current time.

Further, the rotating assembly 2 can be driven by a two-directional motor element, the advantage of the present invention being that there is no need for the user to change his action.

What is claimed is:

1. A multifunction display device for a watch comprising:

a rotating assembly including time indicators and function indicators, said rotating assembly being moved in rotation by a directional mechanism, wherein the function indicators appear at least two times so that the rotating assembly presents the time indicators once and the function indicators at least twice, and wherein the rotating assembly includes a first rotating support including the time indicators, said first rotating support, which includes a hole coincidable with an aperture in a dial, and a second support on which the function indicators are listed several times, a control mechanism of the watch is formed to set in rotation the first rotating support, in a function selection mode of operation, in order to position the hole before the aperture so as to make the second rotating support visible underneath the hole.

2. The display device according to claim 1, wherein the function indicators are divided into two groups arranged one behind the other.

3. The display device according to claim 1, wherein the time indicators are date indicators.

4. The watch including a timepiece movement and a control mechanism to act on said timepiece movement, said timepiece movement including the multifunction display device according to claim 1.

5. The watch according to claim 4, wherein said timepiece movement is electronic.

6. A multifunction display device for a watch comprising:

a rotating assembly including time indicators and function indicators, said rotating assembly being moved in rotation by a directional mechanism, wherein the function indicators appear at least two times so that the rotating assembly presents the time indicators once and the function indicators at least twice, and wherein the rotating assembly includes a first rotating support on which the function indicators are listed several times, said first rotating support, which includes a hole coincidable with an aperture in a dial, and a second support including the time indicators, the hole in the first rotating support coinciding with the aperture in the dial in a normal operating mode in which a current time is displayed, the rotating assembly further including a control mechanism of the watch formed to set in rotation the first rotating support, in a function search mode of operation, so as to position the function indicators opposite the aperture in the dial.

7. The display device according to claim 6, wherein the function indicators are divided into two groups arranged one behind the other.

8. The watch including a timepiece movement and a control mechanism to act on said timepiece movement, said timepiece movement including the multifunction display device according to claim 6.

9. The watch according to claim 8, wherein said timepiece movement is electronic.

10. The display device according to claim 6, wherein the time indicators are date indicators.

* * * * *